US010392759B1

(12) United States Patent
Bahiri et al.

(10) Patent No.: US 10,392,759 B1
(45) **Date of Patent: *Aug. 27, 2019**

(54) DYNAMIC ROAD MARKER

(71) Applicant: VALERANN LTD., Tel Aviv (IL)

(72) Inventors: Shahar Bahiri, Tel Aviv (IL); Daniel Yakovich, Herzeliya (IL)

(73) Assignee: VALERANN LTD., Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/426,263

(22) Filed: May 30, 2019

Related U.S. Application Data

(63) Continuation of application No. 15/125,656, filed as application No. PCT/IL2015/050266 on Mar. 12, 2015, now Pat. No. 10,323,369.
(Continued)

(51) Int. Cl.

| | |
|---|---|
| ***E01F 9/559*** | (2016.01) |
| ***F21S 8/00*** | (2006.01) |
| ***G08G 1/095*** | (2006.01) |
| ***E01F 9/571*** | (2016.01) |
| ***F21V 15/04*** | (2006.01) |

(Continued)

(52) U.S. Cl.
CPC ..... *E01F 9/559* (2016.02); *E01F 9/40* (2016.02); *E01F 9/571* (2016.02); *F21S 8/032* (2013.01); *F21S 9/037* (2013.01); *F21V 15/04* (2013.01); *G08G 1/07* (2013.01); *G08G 1/095* (2013.01); *F21V 21/30* (2013.01);
(Continued)

(58) Field of Classification Search
CPC . G08G 1/07; E01F 9/559; F21V 15/04; F21V 21/30; F21S 8/032; F21Y 2115/10
USPC ..... 340/907
See application file for complete search history.

(56) References Cited

U.S. PATENT DOCUMENTS 3,292,506 A * 12/1966 Kone ..... E01F 9/571 404/11
3,703,855 A 11/1972 Converso
(Continued)

FOREIGN PATENT DOCUMENTS

| | | |
|---|---|---|
| CA | 2672802 | 10/2009 |
| CA | 2672802 A1 | 10/2009 |
| EP | 0989238 | 3/2000 |
| EP | 0989238 A1 | 3/2000 |

OTHER PUBLICATIONS

International Search Report for PCT/IL2015/050266 Search Conducted Jul. 12, 2015; Search dated Jul. 14, 2015 9 Pages.

*Primary Examiner* — Steven Lim
*Assistant Examiner* — Mancil Littlejohn, Jr.
(74) *Attorney, Agent, or Firm* — The Roy Gross Law Firm, LLC; Roy Gross

(57) ABSTRACT

A road marker device comprising: a housing comprising a flat top surface and configured to be inserted in a road such that the flat top surface is leveled with the road surface; a light source housing operatively coupled with the housing, the light source housing comprising at least one aperture protruding from the flat top surface; at least one light source installed in the light source housing, wherein the at least one light source is visible to users of the road through the at least one aperture; and a tilt mechanism installed in the housing and operatively coupled with the light source housing, the tilt mechanism configured to allow descent of the light source housing below the road surface once a pressure is applied on the light source housing.

19 Claims, 17 Drawing Sheets

Related U.S. Application Data

(60) Provisional application No. 61/952,389, filed on Mar. 13, 2014.

(51) Int. Cl.

| | |
|---|---|
| ***G08G 1/07*** | (2006.01) |
| ***F21S 9/03*** | (2006.01) |
| ***E01F 9/40*** | (2016.01) |
| *F21W 111/02* | (2006.01) |
| *F21Y 113/13* | (2016.01) |
| *F21Y 115/10* | (2016.01) |
| *F21V 21/30* | (2006.01) |

(52) U.S. Cl.
CPC ..... *F21W 2111/02* (2013.01); *F21Y 2113/13* (2016.08); *F21Y 2115/10* (2016.08)

(56) References Cited

U.S. PATENT DOCUMENTS

| | | | | |
|---|---|---|---|---|
| 4,955,982 | A * | 9/1990 | Paulos | E01F 9/30 404/11 |
| 5,425,595 | A * | 6/1995 | Roper | E01F 13/046 404/9 |
| 5,857,801 | A * | 1/1999 | Brown | E01F 9/571 404/11 |
| 2002/0105794 | A1* | 8/2002 | Hanscom | B25B 23/18 362/602 |
| 2003/0016997 | A1* | 1/2003 | Attar | E01F 9/553 404/13 |
| 2014/0197955 | A1* | 7/2014 | Martin | G08B 5/36 340/584 |

* cited by examiner

DYNAMIC ROAD MARKER

RELATED APPLICATIONS

This application is a Continuation of U.S. patent application Ser. No. 15/125,656 filed on Sep. 13, 2016, which is a National Phase of PCT patent application No. PCT/IL2015/050266 having International filing date of Mar. 12, 2015, which claims the benefit of priority under 35 U.S.C. § 119(e) of U.S. Provisional Pat. App. Ser. No. 61/952,389 filed on Mar. 13, 2014. The contents of the above applications are all incorporated by reference as if fully set forth herein in their entirety.

FIELD OF THE INVENTION

The present invention relates to the field of road marking.

BACKGROUND

A road marker is a safety device used on roads. These devices are usually made with plastic, ceramic, or occasionally metal, and come in a variety of shapes and colors. Reflective markers may include a lens or sheeting that may enhance their visibility by reflecting automotive headlights. Some other names for specific types of road markers include Botts' dots, delineators, cat's eyes, road studs, or road turtles. The device's reflective surface may enable the device to be clearly visible at long distances at night and in rainy weather. The devices come in multiple colors which vary in usage depending on local traffic marking standards.

The foregoing examples of the related art and limitations related therewith are intended to be illustrative and not exclusive. Other limitations of the related art will become apparent to those of skill in the art upon a reading of the specification and a study of the figures.

SUMMARY

The following embodiments and aspects thereof are described and illustrated in conjunction with systems, tools and methods which are meant to be exemplary and illustrative, not limiting in scope.

There is provided in accordance with an embodiment, a road marker device comprising: a housing comprising a flat top surface and configured to be inserted in a road such that the flat top surface is leveled with the road surface; a light source housing operatively coupled with the housing, the light source housing comprising at least one aperture protruding from the flat top surface; at least one light source installed in the light source housing, wherein the at least one light source is visible to users of the road through the at least one aperture; and a tilt mechanism installed in the housing and operatively coupled with the light source housing, the tilt mechanism configured to allow descent of the light source housing below the road surface once a pressure is applied on the light source housing.

There is provided, in accordance with another embodiment, a network comprising a plurality of road marker devices spread over a network of roads, wherein each of said plurality of road marker devices comprises: a housing comprising a flat top surface and configured to be inserted in a road, wherein the flat top surface is leveled with the road surface; a light source housing operatively coupled with the housing, the light source housing comprising at least one aperture protruding from the flat top surface; at least one light source installed in the light source housing, wherein the at least one light source is visible to users of the road through the at least one aperture; a tilt mechanism installed in the housing and operatively coupled with the light source housing, the tilt mechanism configured to allow descent of the light source housing below the road surface once a pressure is applied on the light source housing; and a communication module configured to communicate with a control center.

There is provided, in accordance with a further embodiment, a method comprising: providing a road marker device, the road marker device comprising a housing having a flat top surface and at least one light source configured to resiliently retract into said housing upon application of external pressure; forming a hole in a road, the hole having at least the size of the road marker device; and positioning the road marker device inside the hole, such that said flat top surface of said road marker device is leveled with a surface of the road, with only said at least one light source protruding upwards from the road marker device.

There is provided, in accordance with another embodiment, a road comprising at least one road marker device, the at least one road marker device comprising: a housing comprising a flat top surface and configured to be inserted in a road, wherein the flat top surface is leveled with the road surface; a light source housing operatively coupled with the housing, the light source housing comprising at least one aperture protruding from the flat top surface; at least one light source installed in the light source housing, wherein the at least one light source is visible to users of the road through the at least one aperture; and a tilt mechanism installed in the housing and operatively coupled with the light source housing, the tilt mechanism configured to allow descent of the light source housing below the road surface once a pressure is applied on the light source housing.

There is provided, in accordance with a yet further embodiment, a road marker comprising: a housing having a flat top surface to be leveled with a road surface; and at least one light source configured to resiliently retract into said housing upon application of external pressure.

In some embodiments, the tilt mechanism comprises: an arm operatively coupled with the light source housing; and a spring operatively coupled with the arm and configured to compress once pressure is applied on the light source housing.

In some embodiments, the tilt mechanism further comprises a shock absorber operatively coupled with said arm and configured to absorb shocks which may be received when said arm is tilted.

In some embodiments, the at least one light source is being at least one Light Emitting Diode (LED).

In some embodiments, the at least one LED is flat.

In some embodiments, the flat top surface comprises a pattern simulating the rough face friction coefficient of the road.

In some embodiments, the light source housing further comprises a recess.

In some embodiments, the light source housing further comprises an upper portion protruding from said flat top surface, and wherein said upper portion has a round shape.

In some embodiments, the road marker device further comprises a seal configured to seal the coupling of said light source housing and said housing.

In some embodiments, said seal comprises a top tapering portion configured to seal the coupling of said tilt mechanism and said light source housing.

In some embodiments, the road marker device further comprises a power source configured to provide energy to said road marker device.

In some embodiments, the power source comprises a solar panel.

In some embodiments, said flat top surface is a lid, and said lid comprises one or more slits configured to facilitate the removal of said lid.

In some embodiments, said light source housing and said tilt mechanism are attached to said lid.

In some embodiments, the road marker device further comprises an ice formation sensor configured to alert of the risk of ice formation on the road.

In some embodiments, the road marker device further comprises a light source assembly, wherein said light source assembly comprises a light source holder and one or more transparent elements, and wherein said at least one light source is mounted on said light source assembly to face at least one of said one or more transparent elements.

In some embodiments, said at least one light source comprises a plurality of light sources in various colors.

In some embodiments, the communication module is configured to communicate with the control center by using a communication selected from the group consisting of: wired communication and wireless communication.

In some embodiments, the method further comprises pouring concrete into said hole, wherein said positioning of said road marker device inside said hole comprises sinking said road marker device in said concrete while said concrete is still wet.

In some embodiments, the road marker device further comprises: a light source housing operatively coupled with the housing, the light source housing comprising at least one aperture protruding from the flat top surface, wherein said at least one light source is installed in said light source housing such that it is visible to users of the road through the at least one aperture; and a tilt mechanism installed in the housing and operatively coupled with the light source housing, the tilt mechanism configured to allow descent of the light source housing below the road surface once a pressure is applied on the light source housing.

In some embodiments, said positioning of the road marker device inside the hole comprises positioning the road marker device such that said at least one aperture faces at least one direction from which users of the road arrive.

In some embodiments, the method further comprises removing said lid via said one or more slits.

In some embodiments, said light source housing and said tilt mechanism are attached to said lid.

In some embodiments, the forming of the hole in the road comprises sinking the road marker device in the road such that the flat top surface is leveled with the surface of the road.

In some embodiments, the road marker device further comprises a resiliency mechanism installed in the housing and operatively coupled with the at least one light source, wherein the resiliency mechanism is configured to allow the resilient retract of said at least one light source into said housing upon application of external pressure.

In some embodiments, the road marker device further comprises: a light source housing operatively coupled with the housing, the light source housing comprising at least one aperture protruding from the flat top surface, wherein said at least one light source is installed in said light source housing such that it is visible to users of the road through the at least one aperture, wherein said resiliency mechanism is operatively coupled with the light source housing and configured to allow descent of the light source housing below the road surface once a pressure is applied on the light source housing.

In some embodiments, the resiliency mechanism comprises a seal configured to seal the coupling of said light source housing and said housing.

In some embodiments, said flat top surface is a lid, and wherein said light source housing and said resilient mechanism are attached to said lid.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

A road marker device for marking a road is disclosed herein. The road marker device may include a dynamic light source, which may be lowered below the road surface once driven over by a passing vehicle. Therefore, the road marker device may be much safer for the vehicle and its passengers and as a result of that may be installed in various locations in the road including sharp turns. The use of such dynamic road marker may prevent accidents and loss of lives by preventing or reducing changes in wheel position or changes in the grip of the road which may occur when a vehicle encounters a fixed road marker device protruding from the surface of the road.

Moreover, damage which may be caused to the road marker device may be prevented or significantly reduced, thus extending the lifetime of the road marker device and its components. The disclosed road marker device may also prevent or reduce vehicles' vibration, tire wear and bumping wheels. Furthermore, such configuration may allow the use of the road marker device in snowy roads since it may withstand the operation of a snow plow.

In addition, the disclosed road marker device may be assembled such as to enable performing maintenance operations and repositioning of the road marker device in a simple and economical manner, with no need for special equipment and/or previous knowledge.

The disclosed road marker device may be environmentally friendly by utilizing the sunlight as the power source and since it may not require infrastructure, it may not harm nature and the environment both physically and visually.

Furthermore, a network of such road marker devices spread over a network of roads is disclosed. Such network may allow a remote control of the operation of the road marker devices and receipt of various local data in real-time. Therefore, such network may enhance the safety, functionality and capacity of the roads.

The terms "vehicle" and "car" may be used interchangeably throughout the application and may refer to vehicles, such as private or commercial cars, trucks or vans, aircrafts (i.e., when travelling on land, taking off or landing), two-wheeled vehicles such as motorcycles or bicycles, or to mechanical equipment such as agricultural machines.

The term "road", as referred to herein, may relate to any portion of ground which is designated for the use of a vehicle, including roadways, highways, runways and bike lanes.

The term "turning on" with respect to a light source of a road marker device, may include turning the light source on such that it flashes or intermittently illuminated or continuously illuminated.

Figure 1A:
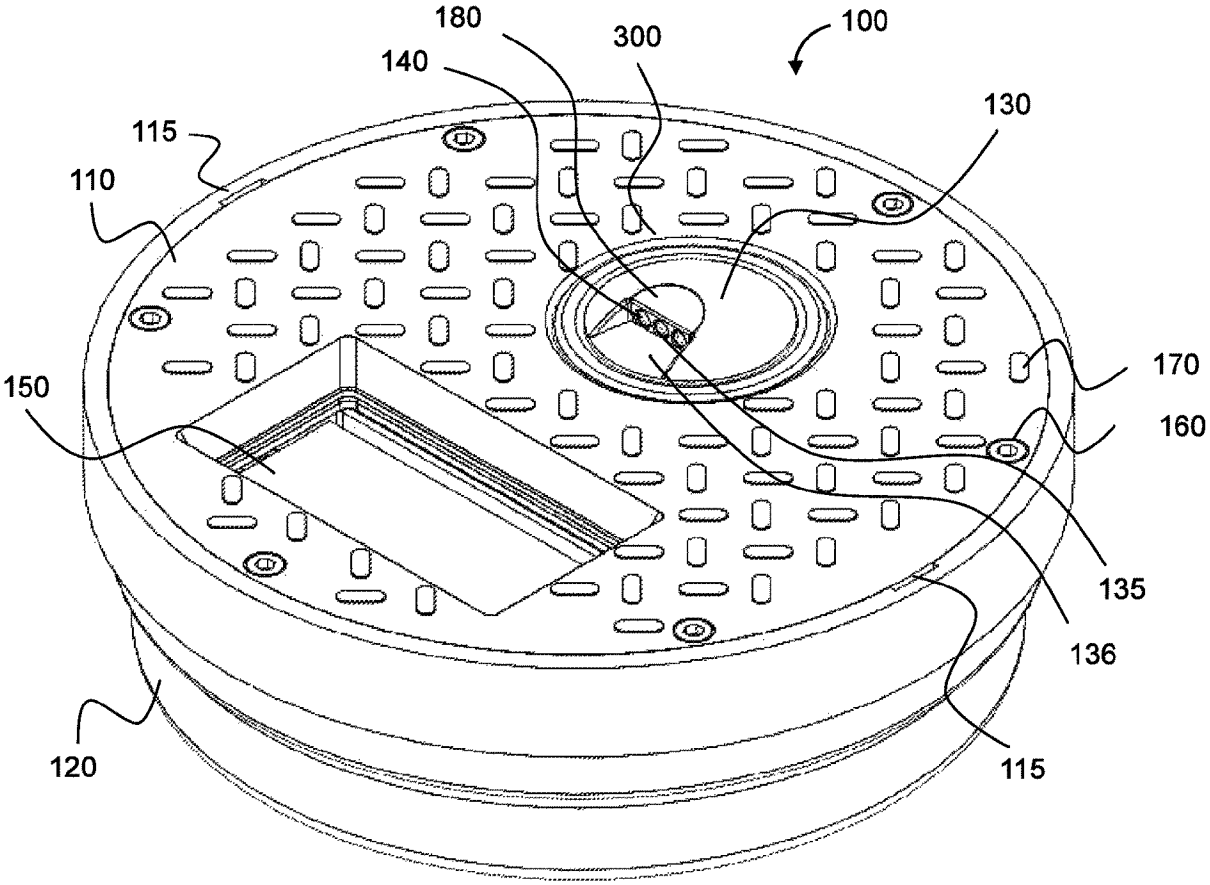
FIG. 1A shows a schematic illustration of a top isometric view of an exemplary embodiment of a road marker device.
Figure 1B:
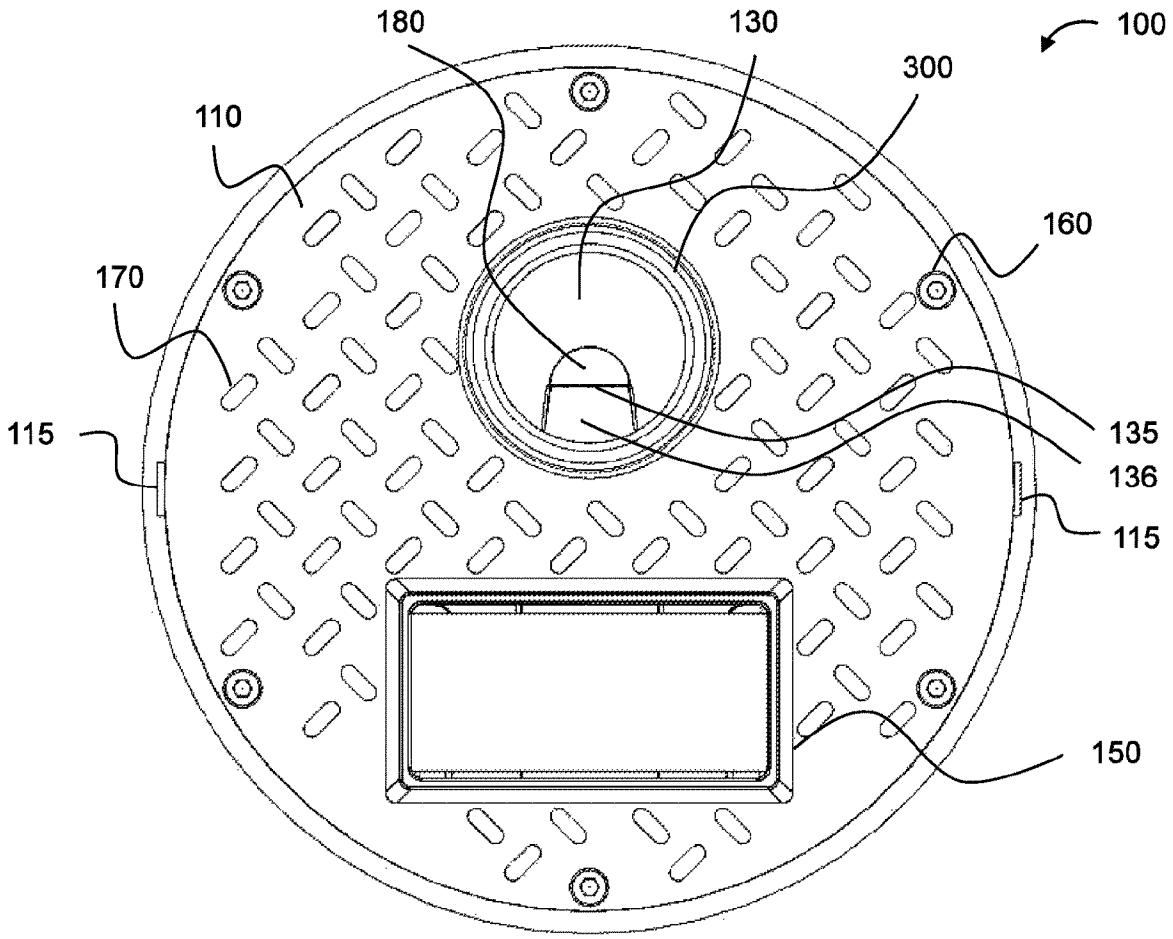
FIG. 1B shows a schematic illustration of a top view of the road marker device of FIG. 1.

Reference is now made to FIGS. 1A and 1B. FIG. 1A shows a top isometric view of an exemplary embodiment of a road marker device 100. FIG. 1B shows a top view of road marker device 100. Road marker device 100 may include a housing, which may include a flat top surface 110 and a container 120, a light source housing 130, a light source 140, a tilt mechanism (not shown) and a seal 300 (shown in FIGS. 4-6B and 8A and 8B). Light source housing 130 may include an aperture 135.

The housing may be configured to be inserted in a road and such that flat top surface 110 may be leveled with the road surface. For example, the housing may be inserted into a hole in the road corresponding to the measures of the housing. Light source housing 130 may be coupled with the housing and such that aperture 135 protrudes from flat top surface 110. For example, flat top surface 110 may include an opening through which aperture 135 may protrude (not shown).

Light source 140 may be installed in light source housing 130. Light source 140 may be installed in light source housing 130 such that it may be visible to users of the road (e.g., car drivers or pedestrians) through aperture 135. Light source 140 may be installed adjacently to aperture 135 and/or such that a front surface of light source 140 is aligned with or protruding from aperture 135. Aperture 135 may be formed in a niche 136 in light source housing 130 (as shown in FIGS. 1A and 1B), thus less exposing light source 140 to influences of the environment.

Figure 2:
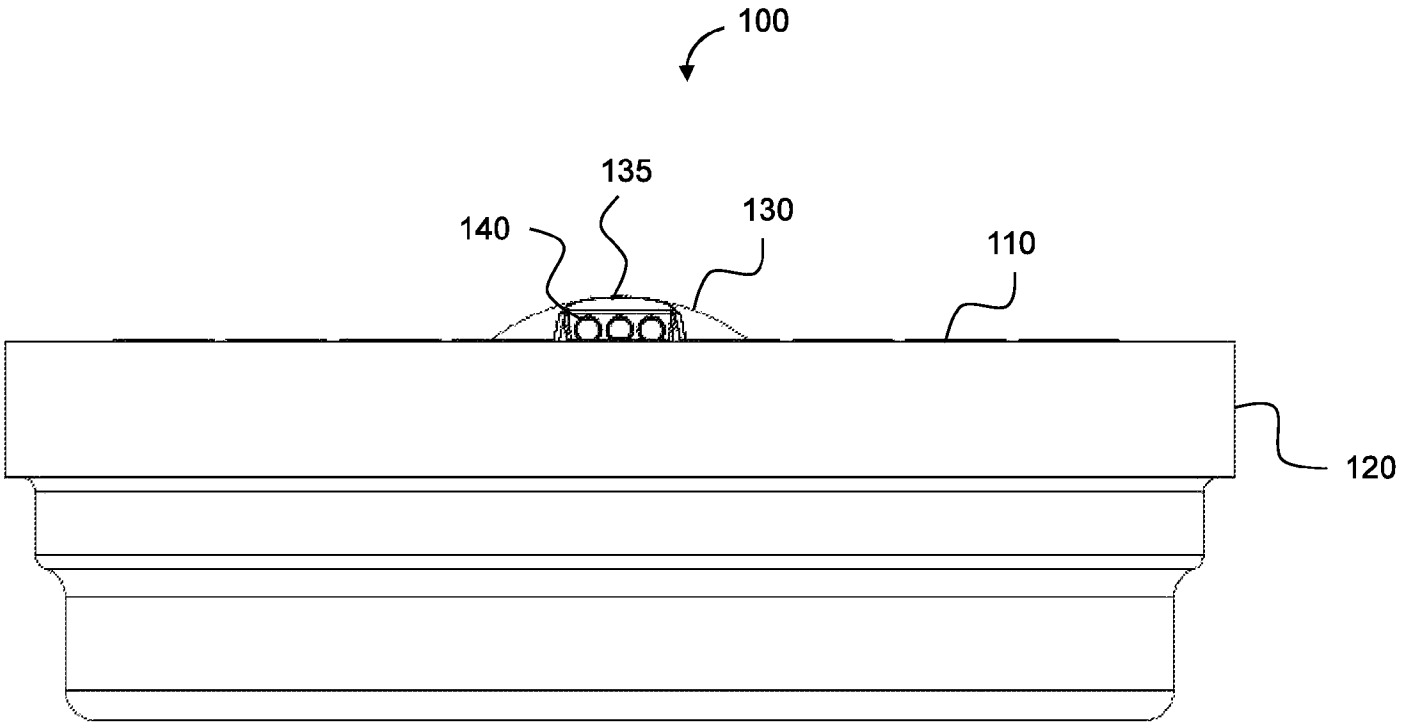
FIG. 2 shows a schematic illustration of a front view of the road marker device of FIG. 1.

Reference is now made to FIG. 2, which shows a schematic illustration of a front view of road marker device 100. As one can see, aperture 135 protrudes from flat top surface 110 and light source 140 may be visible to users of the road through aperture 135, such as users arriving from a direction facing aperture 135.

Road marker device 100 may further include a power source for providing energy to road marker device 100. The power source may be a solar panel 150. Solar panel 150 may be covered by a transparent flat plate leveled with flat top surface 110. Solar panel 150 may absorb sunlight, convert it to electrical power, and transmit the power to one or more batteries which may store the energy for later and/or concurrent use. Solar panel 150 may be couple with light source 140 via an electronic circuit. The electronic circuit may control the turning on/off of light source 140, for example, according to the charging status of solar panel 150. When solar panel 150 is in the process of charging, i.e., solar panel 150 receives sunlight, light source 140 may be turned off and vice versa. The electronic circuit may further control the charging of the batteries by receiving indication of its charging status. The electronic circuit may be sealed in a waterproof cover to prevent the penetration of water and moist.

The tilt mechanism may be operatively coupled with light source housing 130. The tilt mechanism may be installed in the housing. The tilt mechanism may be used to allow the descending of light source housing 130 once a pressure is applied on it and may return it to its original position once the pressure is off. Thus, each time a vehicle drives over light source housing 130, it may descend below the road surface to remove any resistance. Therefore, damage which may be caused to the light source housing 130 and/or its content (e.g., light source 140) and to the vehicle and its passengers may be prevented or reduced. Furthermore, in snow conditions, light source housing 130 may descend as a result of the operation of a snow plow (i.e., sweeping the snow off). The descending of light source housing 130 below the surface of the road may remove any resistance to the snow plow movement and operation (i.e., in order to prevent damage), and may allow it to sweep off snow accumulating on the flat top surface of the road marker device (e.g., in order to expose the solar panel to sunlight).

The tilt mechanism may utilize various elements, mechanisms and/or materials in order to tilt the light source housing in response to applied pressure, such as a spring (as shown in FIGS. 4-6B), an elastic material (e.g., an elastomer) or a pneumatic mechanism.

In some embodiments, light source housing 130 may include an upper portion enclosing aperture 135 and therefore protruding from flat top surface 110. Such upper portion may be in the form of a dome or any other round shape, as shown in FIGS. 1A and 2. Such a round shape may facilitate driving over light source housing 130 and further prevent or reduce damage which may be caused as a result of that. In some embodiments, light source housing 130 may include a recess 180. Recess 180 may be located above light source 140 and as an extension of opening 135. Recess 180 may facilitate the operation of a snow plow, which otherwise may be caught by opening 135.

The dimensions of aperture 135 may determine its field of view. The field of view may be determined by a vertical angle (i.e., a vertical field of view) and a horizontal angle (i.e., a horizontal field of view) with respect to the road. The vertical angle may be determined by the height of aperture 135 and the horizontal angle may be determined by its width. The field of view of aperture 135 may limit the area of illumination of light source 140. For example, aperture 135 may have a horizontal field of view of less than 90 degrees, e.g., 20 degrees, thus allowing illumination only towards a specific direction, as shown in FIGS. 1A, 1B and 2. In some embodiments, the aperture may be wider in order to face more than one direction. Optionally, the aperture may be panoramic (i.e., aperture having a horizontal field of view of 360 degrees). Alternatively, the light source housing may include a plurality of narrower apertures, each facing a different direction. Light source 140 may include an active light source, such as a Light Emitting Diode or a bulb. Optionally, light source 140 may include a passive light source such as a reflective lens. The road marker device may include a plurality of light sources. For example, road marker device 100 may include three light sources 140, e.g., three LEDs. The light sources may be of various colors. In some embodiments, the light sources may be flat LEDs having, for example, an oval or rectangular shape. Thus, the light sources may not protrude towards or through aperture 135, and damage which may be caused due to exposure of the light sources to the exterior (i.e., through aperture 135) may be prevented or reduced.

Figure 3:
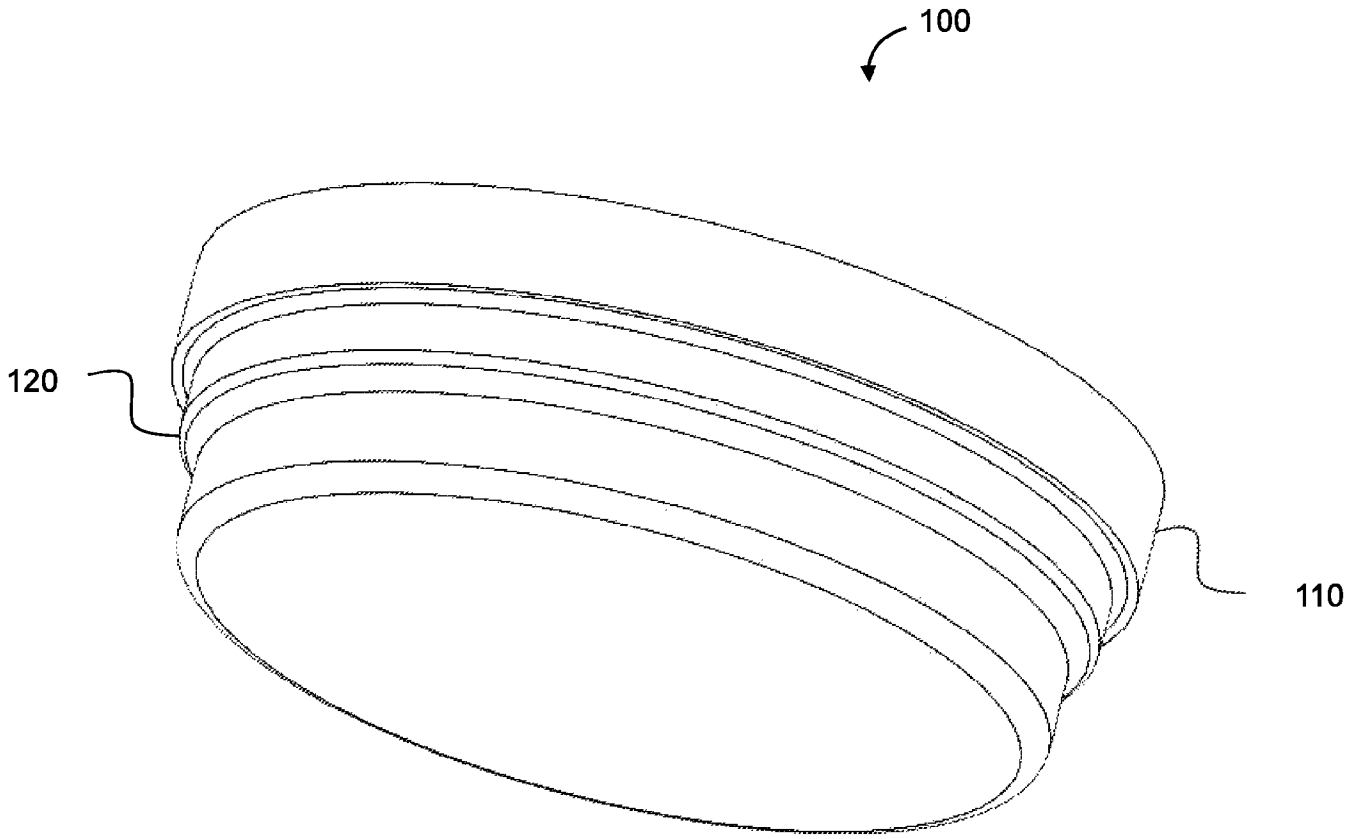
FIG. 3 shows a schematic illustration of a bottom isometric view of the road marker device of FIG. 1.

In some embodiments, the housing may be a single integrated unit. In some embodiments, the housing may be an assembly. For example, the housing may include a lid serving as flat top surface 110 and container 120. Reference is now made to FIG. 3, which shows a schematic illustration of a bottom isometric view of road marker device 100. The housing may include a lid 110 designated to close container 120. Container 120 may include a graded exterior. The exterior of container 120 may include a top grade to facilitate the extraction of road marker device 100 from the road. Lid 110 may include one or more slits 115, e.g., two slits, four or six slits 115, in order to facilitate the removal of lid 110. Lid 110 may further include a plurality of screws 160 for firmly attaching lid 110 to container 120.

In some embodiments, the tilt mechanism may be installed in the housing by attaching it to lid 110, and light source housing 130 may be coupled with the housing by attaching it to lid 110 as well. Furthermore, any additional mechanical or electronic component of road marker device 100 installed in the housing may be attached to lid 110. By "attaching to lid 110" it is meant here attaching directly or indirectly, e.g., via another component which is directly attached to lid 110. Therefore, maintenance of road marker device 100 may only require opening and/or lifting lid 110 (e.g., by unscrewing screws 160) since the components of road marker device 100 may be attached to it.

In some embodiments, the flat top surface may include a pattern 170 simulating the rough face friction coefficient of asphalt. Such pattern may facilitate driving over the road marker device. For example, flat top surface 110 includes such a pattern, pattern 170, as shown in FIGS. 1A and 1B.

Figure 4:
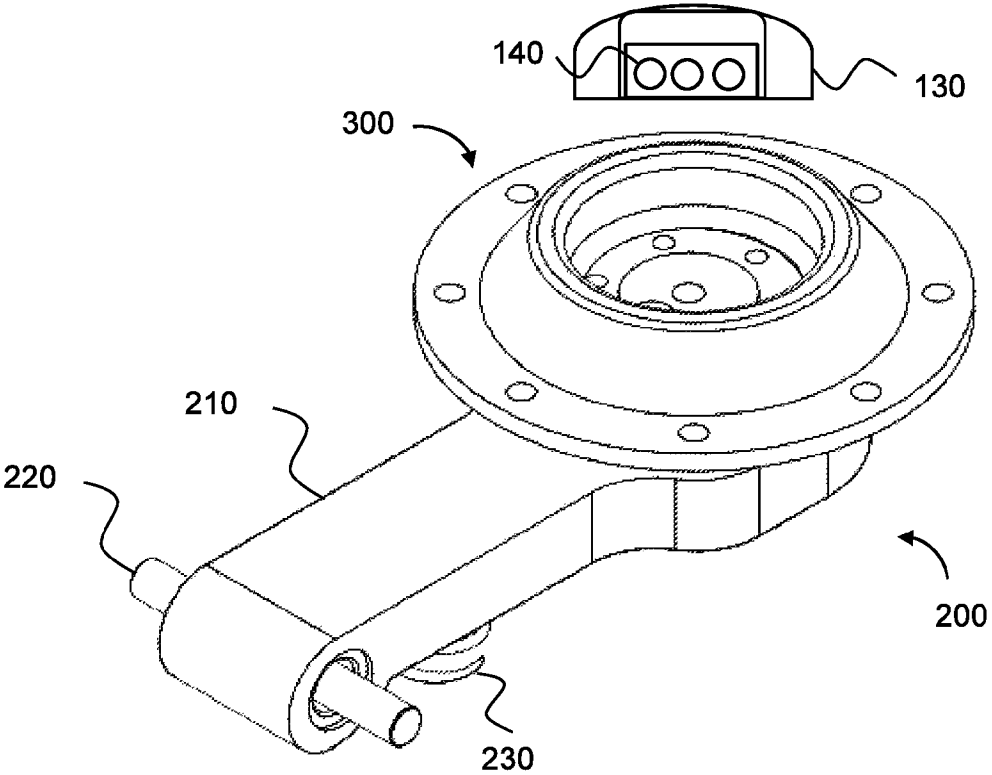
FIG. 4 shows a schematic illustration of a top isometric view, partially exploded, of an exemplary tilt mechanism coupled with a seal and a light source housing.
Figure 5:
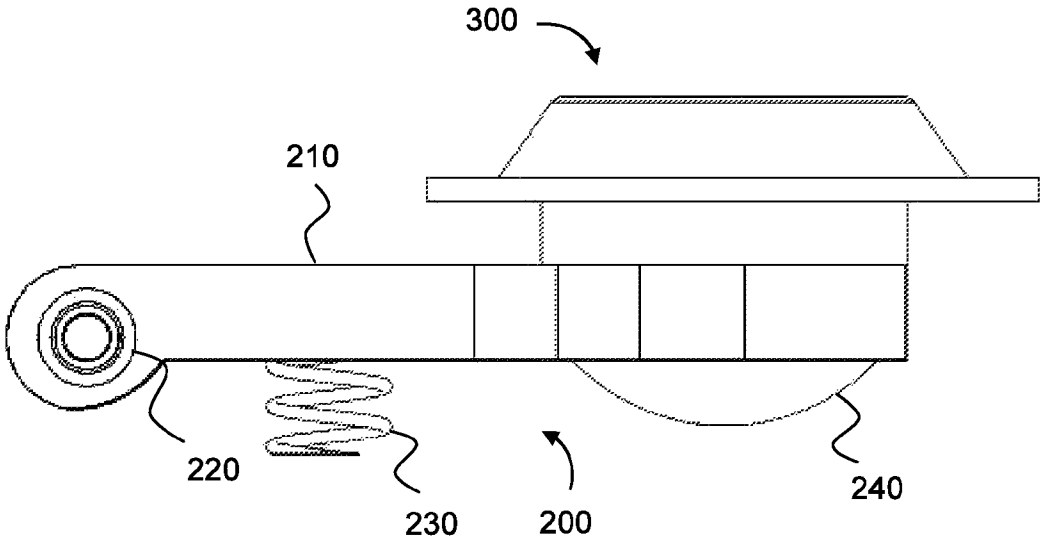
FIG. 5 shows a schematic illustration of a side view of the tilt mechanism and seal of FIG. 4.
Figure 6A:
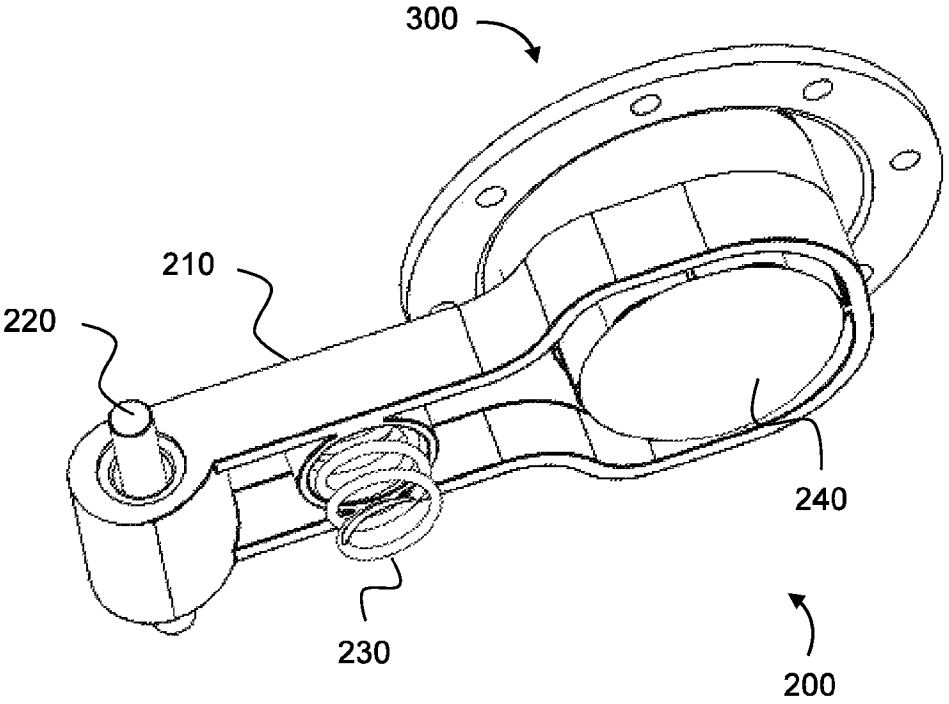
FIG. 6A shows a schematic illustration of a bottom isometric view of the tilt mechanism and seal of FIG. 4.
Figure 6B:
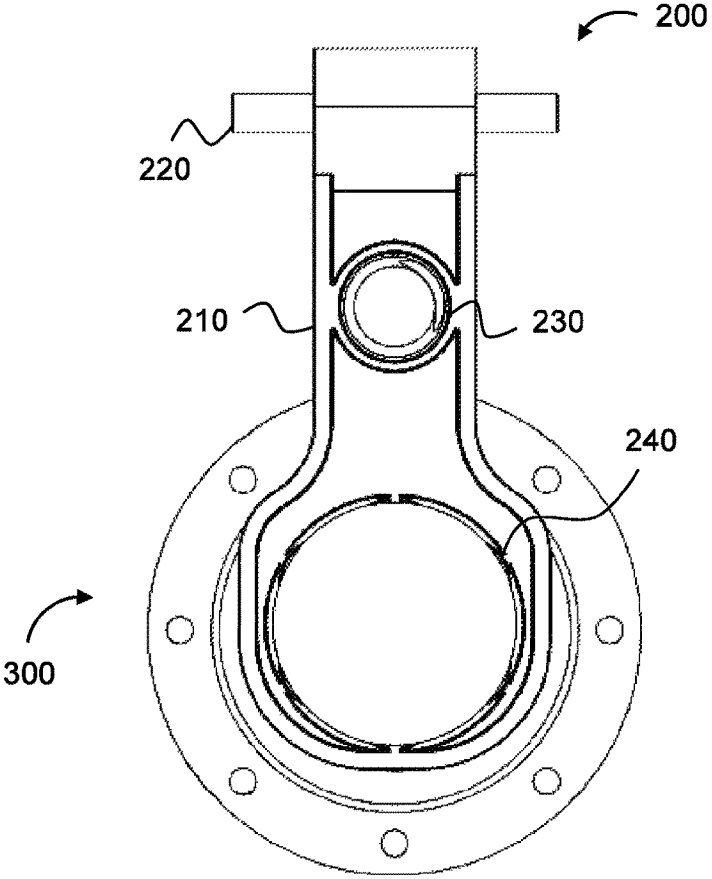
FIG. 6B shows a schematic illustration of a bottom view of the tilt mechanism and seal of FIG. 4.
Figure 7:
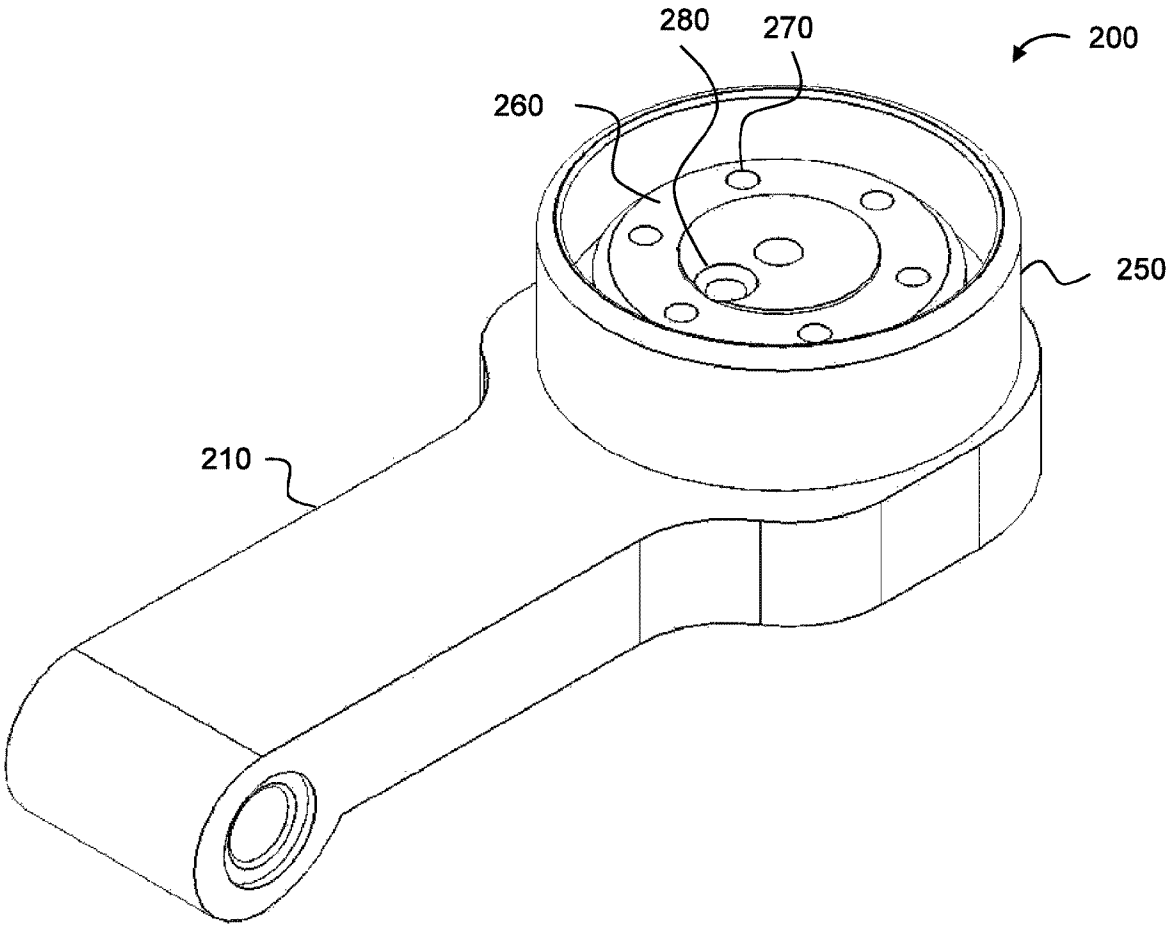
FIG. 7 shows a schematic illustration of a top isometric view of a portion of the tilt mechanism of FIG. 4.

Reference is now made to FIGS. 4, 5, 6A, 6B and 7. FIG. 4 shows a schematic illustration of a top isometric view, partially exploded, of an exemplary tilt mechanism 200 coupled with a seal 300 and light source housing 130. FIG. 5 shows a schematic illustration of a side view of tilt mechanism 200 and seal 300 of FIG. 4. FIG. 6A shows a schematic illustration of a bottom isometric view of tilt mechanism 200 and seal 300 of FIG. 4. FIG. 6B shows a schematic illustration of a bottom view of tilt mechanism 200 and seal 300 of FIG. 4. FIG. 7 shows a schematic illustration of a top isometric view of a portion of tilt mechanism 200 of FIG. 4.

Tilt mechanism 200 may include an arm 210, a hinge 220 and a spring 230. Optionally, tilt mechanism 200 may further include a light housing footing 260, a seal support 250 and a shock absorber 240. Arm 210 may be operatively coupled with hinge 220, spring 230, light housing footing 260, seal support 250 and shock absorber 240. Arm 210 may be configured to be tilted on hinge 220. For example, arm 210 may be configured to be tilted up and down on hinge 220 with respect to the road. Spring 230 may be configured to tilt arm 210 in one direction and to allow tilt, e.g., descent of arm 210 in the other direction. For example, arm 210 may be mounted on spring 230. When a pressure is applied on arm 210 pushing it down, spring 230 may compress. Once the pressure is off, spring 230 may stretch to its original shape thus pushing arm 210 up to its original position. Shock absorber 240 may be designated to absorb a shock which may be received when arm 210 is tilted. For example, shock absorber 240 may be positioned below arm 210 to absorb shocks which may be received when arm 210 is pushed down. Shock absorber 240 may be made of absorbing materials such as rubber.

Tilt mechanism 200 may be coupled with light source housing 130. Optionally, tilt mechanism 200 may be coupled with light source housing 130 by light housing footing 260. Light housing footing 260 may include screw holes 270 and one or more utility openings 280. Light source housing 130 may be attached to light housing footing 260 by screws screwed through screw holes 270. Utility openings 280 may be used, for example, to allow the passage of electric wires to light sources 140.

Thus, when light source housing 130 is pushed down and resiliently retracts into the housing (e.g., by a vehicle driving over it), arm 210 is pushed down and as a result of that spring 230 is compressed. When the pressure is off (e.g., when the vehicle passes light source housing 130), spring 130 may stretch to its original shape therefore pushing arm 210 and as a result of that light source housing 130 up to its original position, i.e., protruding from flat top surface 110. Tilt mechanism 200 may be configured to allow pushing down of light source housing 130 below flat top surface 110.

Optionally, light source housing 130 may be coupled with the housing, e.g., lid 110, by a seal 300. Seal 300 may be used to seal the coupling of light source housing 130 with tilt mechanism 200 and flat top surface 110 as shown in FIGS. 1A, 1B and 4. Such seal may be required to prevent the penetration of dirt, dust etc. into light source housing 130 and the housing. Seal 300 may be resilient to allow it to be pushed down conjointly with light source housing 130. Seal 300 may, for example, include rubber.

Figure 8A:
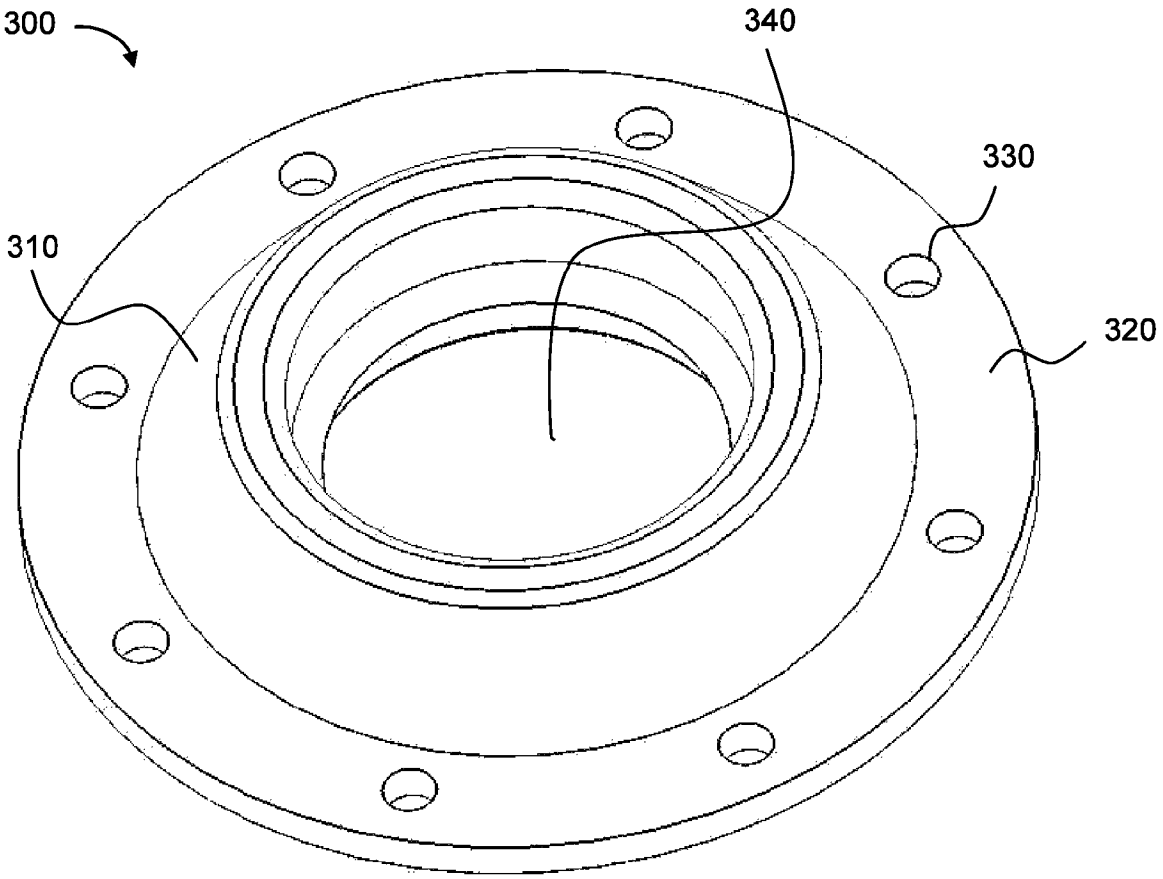
FIG. 8A shows a schematic illustration of a top isometric view of the seal of FIG. 4.
Figure 8B:
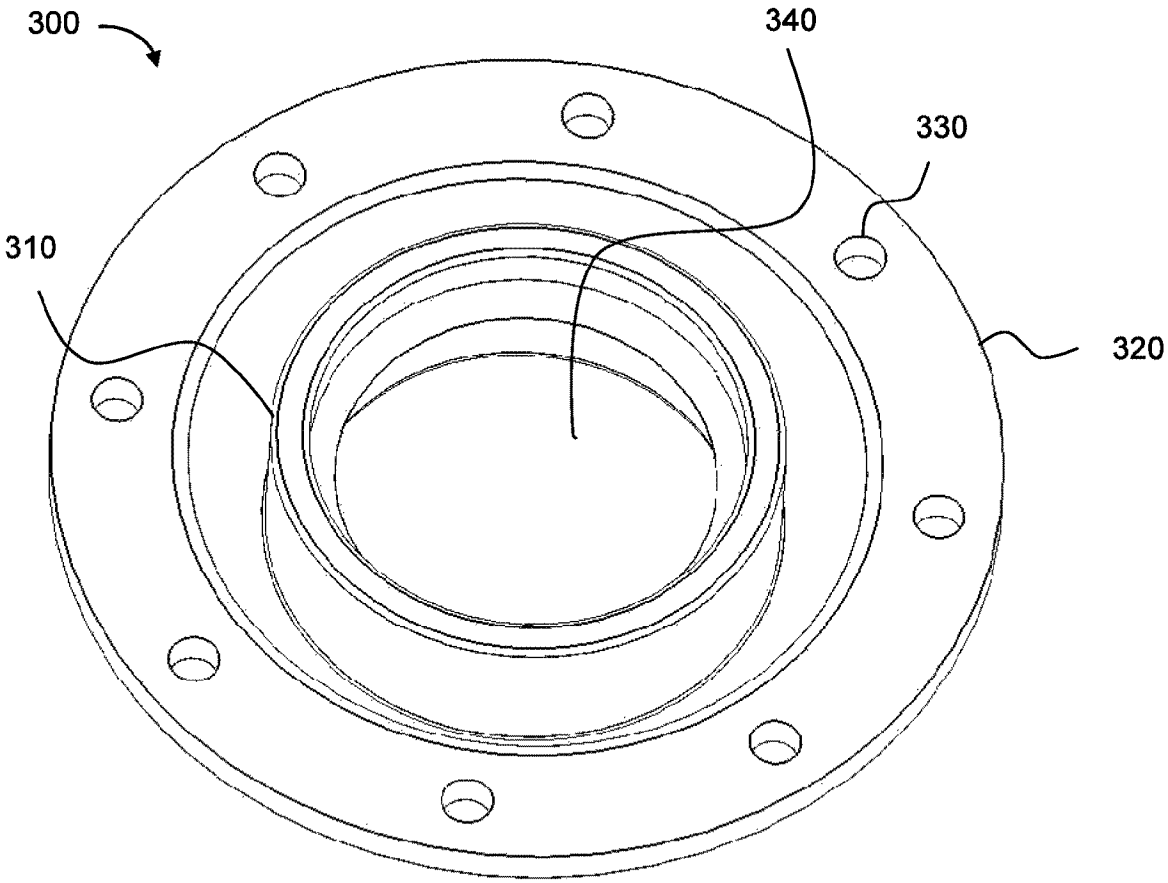
FIG. 8B shows a schematic illustration of a bottom isometric view of the seal of FIG. 4.

Reference is now made to FIGS. 8A and 8B. FIG. 8A shows a schematic illustration of a top isometric view of seal 300 of FIG. 4. FIG. 8B shows a schematic illustration of a bottom isometric view of seal 300 of FIG. 4. Seal 300 may be annular. Seal 300 may include a top tapering portion 310, a bottom annular portion 320 and a central cavity 340. Top tapering portion 310 may be configured to seal the coupling of tilt mechanism 200 and light source housing 130. Top tapering portion 310 may be hollow, as shown in FIG. 8B. Top tapering portion 310 may include an elastic wall. Thus, the elastic wall may include folds, as shown in FIG. 8A, which may stretch once light source housing 130 descends. Bottom annular portion 320 may be configured to seal the coupling of the top surface of the housing and light source housing 130. Bottom annular portion 320 may include screw holes 330. Seal 300 may be mounted on seal support 250, as shown in FIGS. 4-6B. Seal support 250 may be received by hollow tapering portion 310. Seal 300 may be coupled with lid 110 by screws inserted into screw holes 330. Light source housing 130 may be received by central cavity 340, as shown in FIGS. 1A, 1B and 4. Light source housing 130 may be coupled with seal 300 and/or light housing footing 260 in various manners, as known in the art. Optionally, an inner end portion of top tapering portion 310 (e.g., the lowest fold or portion of the elastic wall) may be pressed between an edge portion of light housing footing 260 and a bottom edge portion of light source housing 130. Thus, when light source housing 130 is firmly attached to light housing footing 260 (e.g., by screws inserted to screw holes 270), seal 300 is firmly coupled to both therefore sealing the housing against environmental influences.

In some embodiments, road marker device 100 may include a resiliency mechanism as an alternative to the tilt mechanism. The resiliency mechanism may include seal 300 and light housing footing 260 of the tilt mechanism. Seal 300 may be operatively coupled with light housing 130 and light housing footing 260 as described herein above. Light housing 130 may be coupled with light housing footing 260 as described herein above. Thus, when pressure is applied on light source housing 130, the elastic wall of top tapering portion 310 of seal 300 may stretch downwards, by that allowing light source housing 130 to descend. Once the pressure is removed, the elastic wall may fold back to its original form, by that pulling light source housing 130 upwards and back to its original position, i.e., to protrude from flat top surface 110.

Figure 9A:
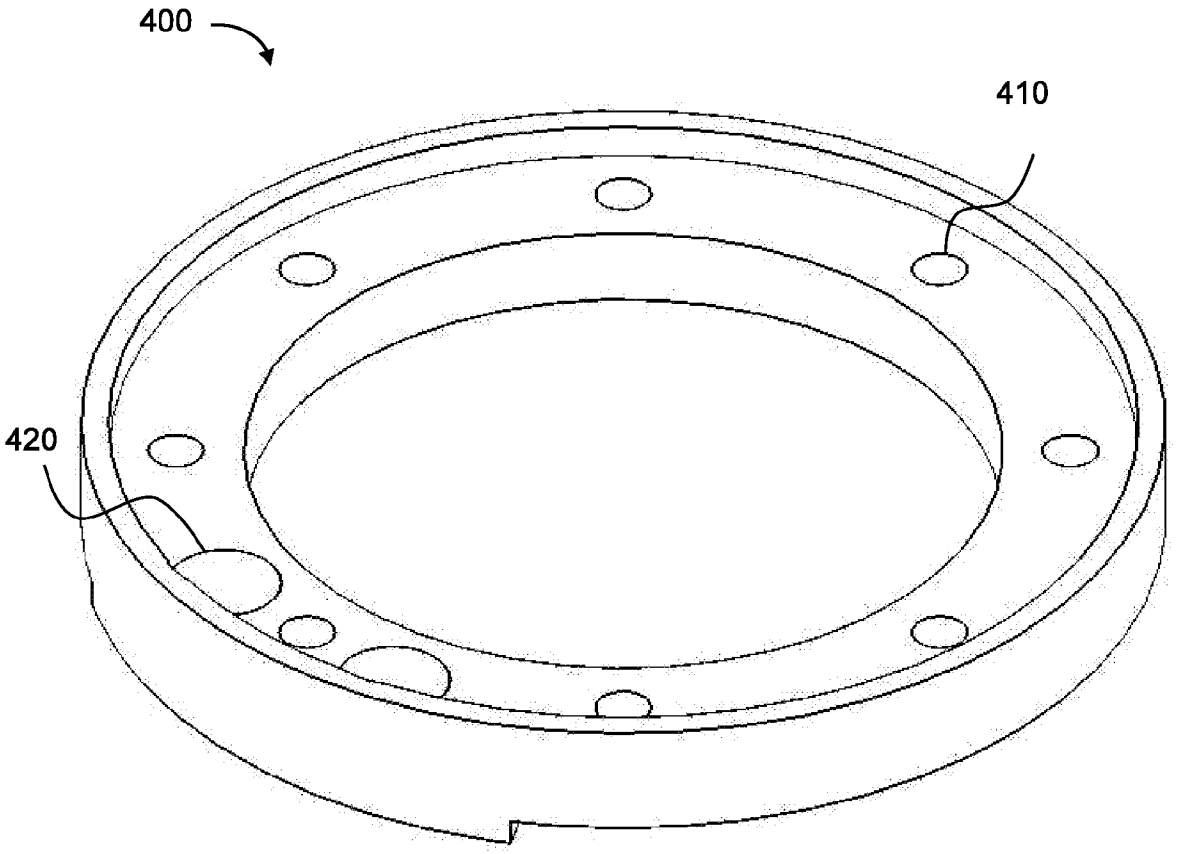
FIG. 9A shows a schematic illustration of a top isometric view of a ring connector.
Figure 9B:
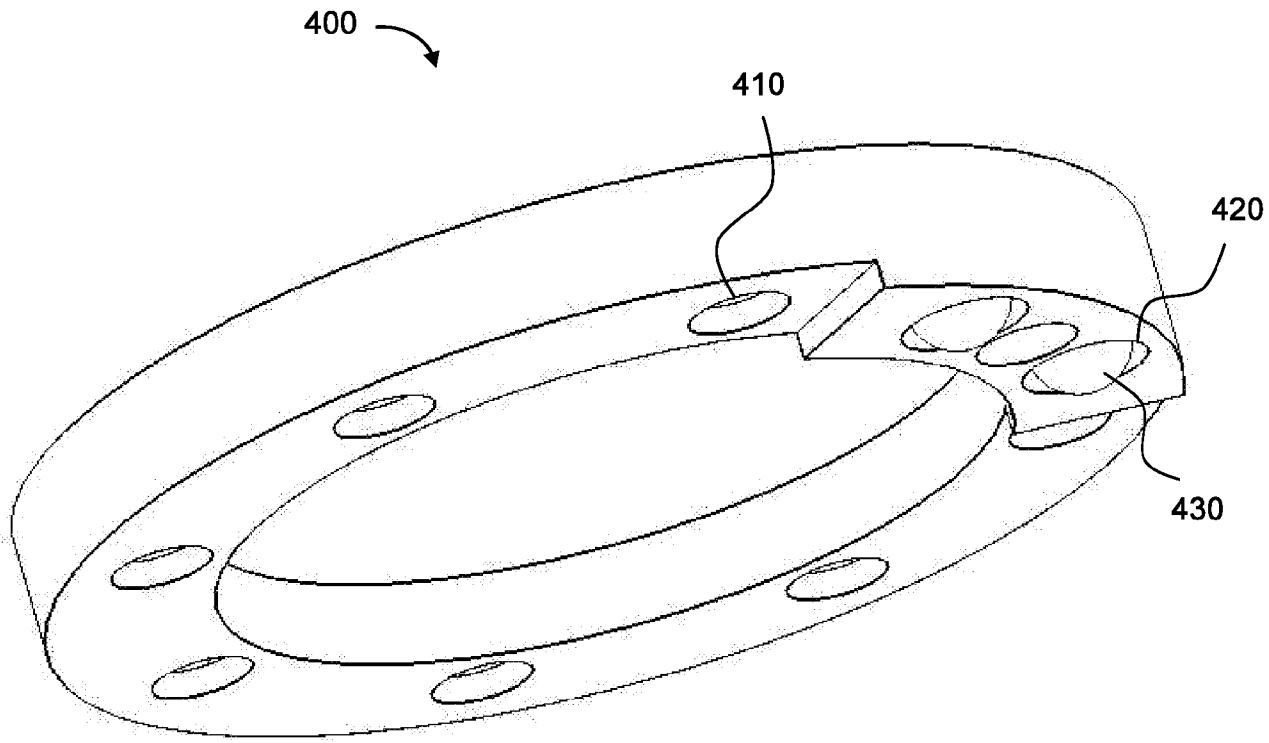
FIG. 9B shows a schematic illustration of a bottom isometric view of the ring connector of FIG. 9A.

Reference is now made to FIGS. 9A and 9B. FIG. 9A shows a schematic illustration of a top isometric view of a ring connector 400. FIG. 9B shows a schematic illustration of a bottom isometric view of ring connector 400 of FIG. 9A. Ring connector 400 may be configured to firmly attach seal 300 to the housing (e.g., to its flat top surface or lid 110). Ring connector 400 may include screw holes 410. Ring connector 400 may further include shock absorber dents 420 and shock absorbers 430. Ring connector 400 may be attached to seal 300. Screw holes 410 may correspond to screw holes 330 of bottom annular portion 320 of seal 300. Thus, seal 300 and ring connector 400 may be attached to the top flat surface by screws screwed through screw holes 410 and screw holes 330 correspondingly. Ring connector 400 may include a central cavity. Thus, light source housing 130 may be received by the central cavity of ring connector 400 and central cavity 340 to outwardly protrude from the top flat surface of the housing. Shock absorbers 430 may be configured to absorb shocks received by tilt mechanism 200 (e.g., arm 210), in case such is utilized, when it is pushed up to its original position by the stretching of spring 130. Shock absorber dents 420 may be configured to receive shock absorbers 430. Shock absorber dents 420 may be holes.

Figure 10A:
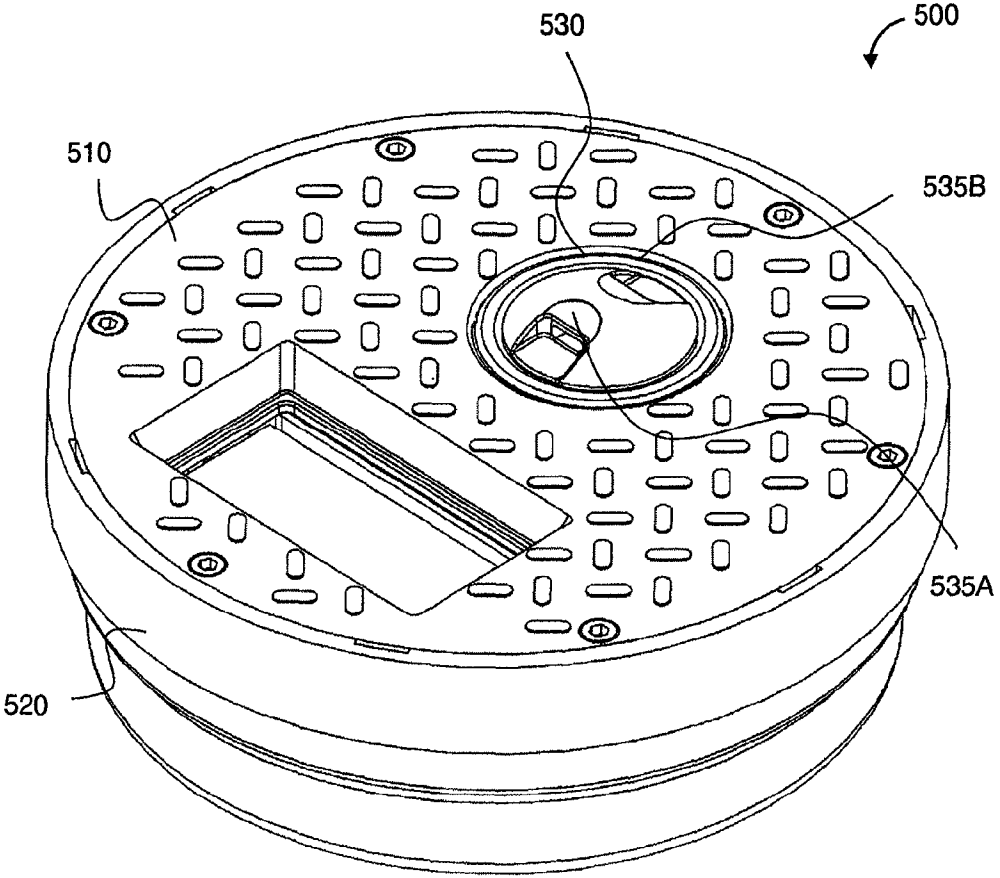
FIG. 10A shows a schematic illustration of a top perspective view of a road marker device according to another embodiment.
Figure 10B:
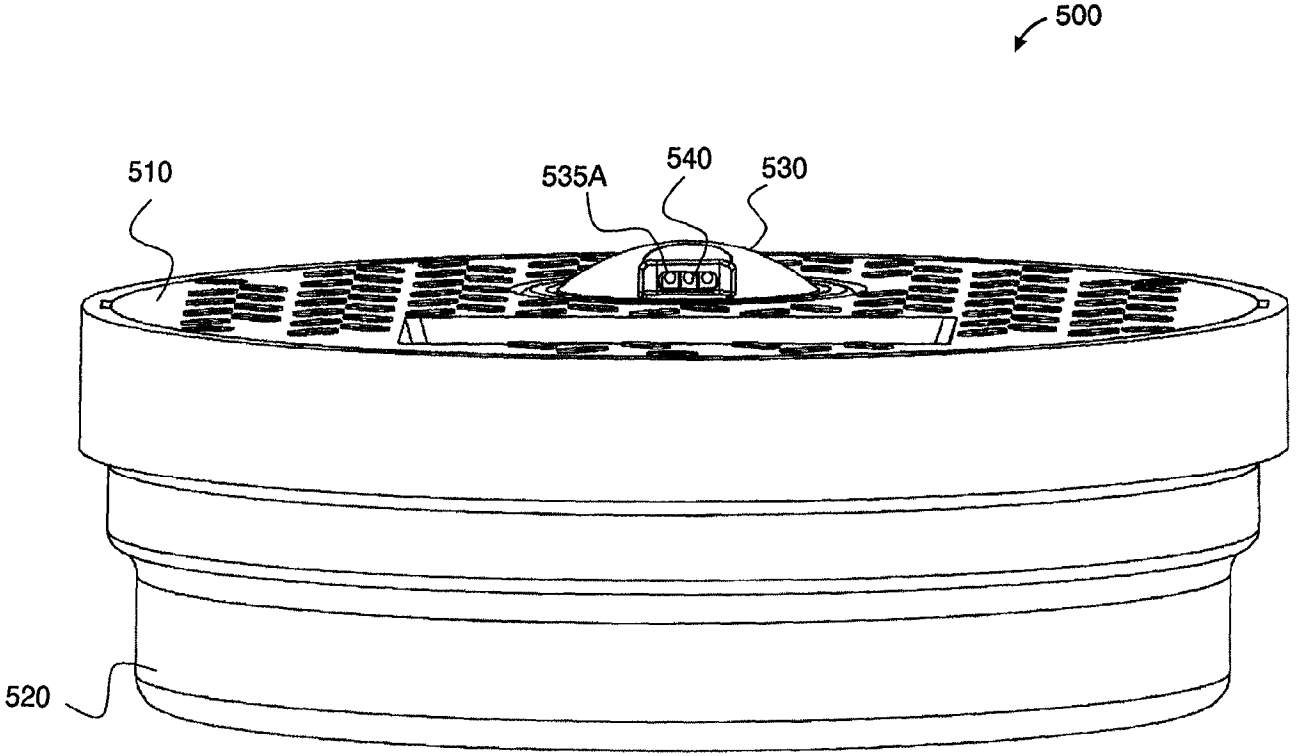
FIG. 10B shows a schematic illustration of a front perspective view of the road marker device of FIG. 10A.

Reference is now made to FIGS. 10A and 10B. FIG. 10A shows a schematic illustration of a top perspective view of a road marker device 500 according to another embodiment. FIG. 10B shows a schematic illustration of a front perspective view of the road marker device of FIG. 10A.

Road marker device 500 (or simply 'device 500') may be similar to road marker device 100 with modifications as detailed herein below. Device 500 may include a housing, which may include a flat top surface 510 and a container 520, a light source housing 530, light sources 540, light source assembly 600 (shown in FIG. 11) and a seal (not shown). Road marker device 500 may further include a tilt mechanism or a resiliency mechanism (not shown). In some embodiments, light sources 540 of road marker device 500 may be LEDs and flat LEDs in particular. Light source housing 530 may include two apertures 535A and 535B. Apertures 535A and 535B may be positioned in opposite sides of light source housing 530, thus forming a bi-directional road marker device. Light sources 540 may be positioned within light source housing 530. One or more of light sources 540 may face and therefore illuminate through aperture 535A and the rest may face and therefore illuminate through aperture 535B. Since light sources 540 are positioned within source housing 530 (i.e., not aligned with or adjacent to aperture 535A and/or 535B), they are not shown in FIG. 10A but only in FIG. 10B. FIG. 10B provides a front view of road marker device 500 and aperture 535A, through which a portion of light sources 540 are shown. Light sources 540 may be mounted on light source assembly 600, and both may be positioned within light source housing 530.

Figure 11A:
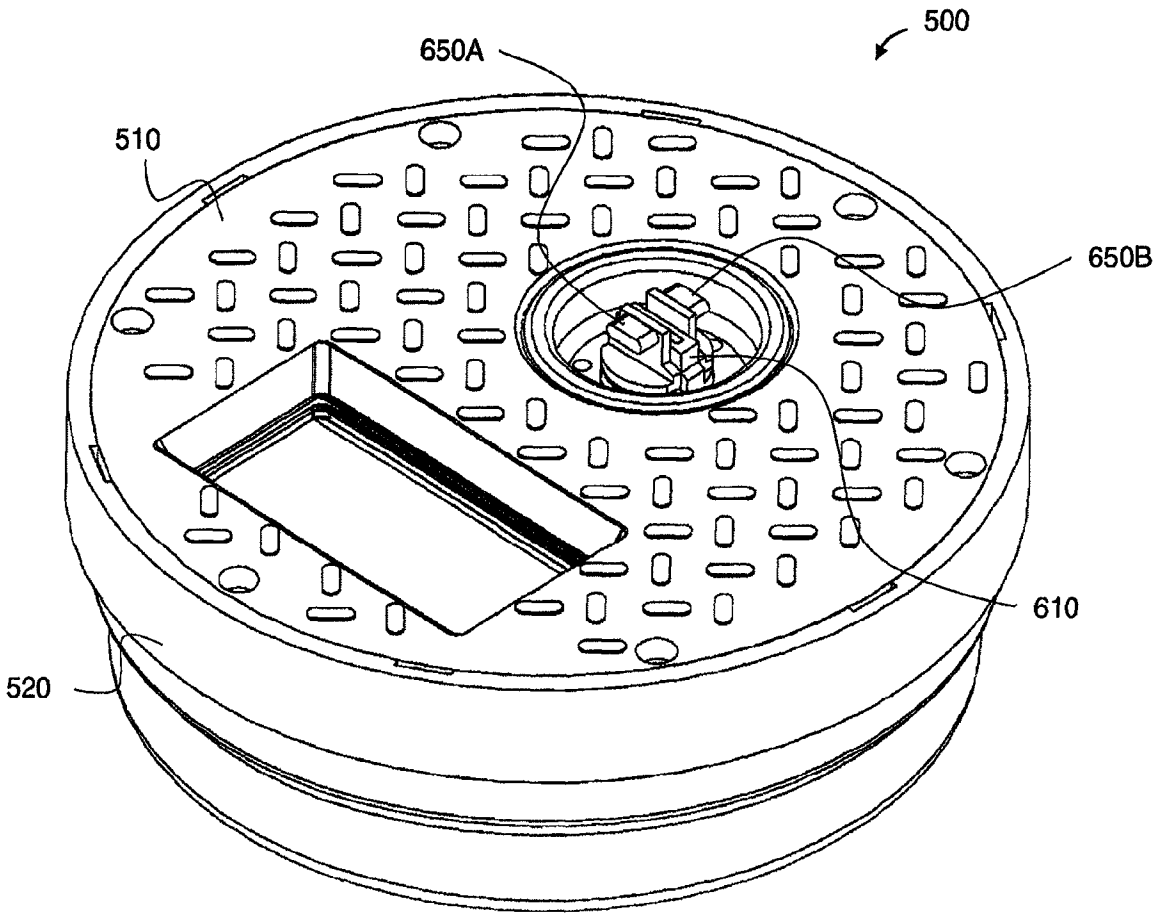
FIG. 11A shows a top isometric view of the road marker device of FIG. 10A while its light source housing and light sources are removed, thus showing its light source assembly.
Figure 11B:
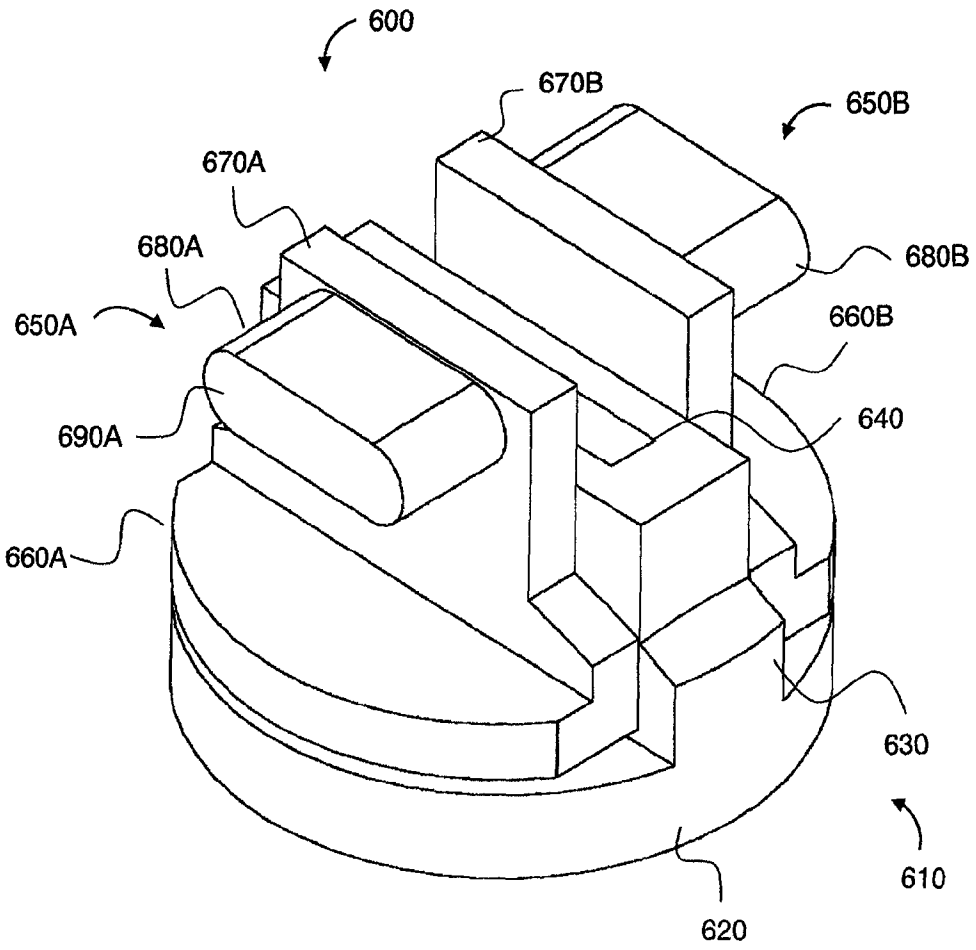
FIG. 11B shows a top isometric view of the light source assembly of FIG. 11A.

Reference is now made to FIGS. 11A and 11B. FIG. 11A shows a top isometric view of road marker device 500 of FIG. 10A while light source housing 530 and light sources 540 are removed, thus showing light source assembly 600. FIG. 11B shows a top isometric view of light source assembly 600 of FIG. 11A.

Light source assembly 600 may include a light source holder 610 and two transparent elements 650A and 650B. Light source holder 610 may include a base 620 and a carrier 630. Carrier 630 may include a slit 640. Light source holder 610 may be made of materials such as plastic.

Transparent element 650A may include a base 660A, a wall 670A and a dispersing element 680A. At least a portion of wall 670A and dispersing element 680A may be transparent. Transparent element 650B may include a base 660B, a wall 670B and a dispersing element 680B. At least a portion of wall 670B and dispersing element 680B may be transparent.

Transparent element 650A and transparent element 650B may be at least partially made of a transparent material such as polycarbonate. Transparent element 650A and transparent element 650B may be similar and may be positioned in opposite sides of light source assembly 600. Transparent element 650A and transparent element 650B may be positioned on base 620. Transparent element 650A may correspond to aperture 535A and such that at least a portion of a front surface 690A of dispersing element 680A may be shown through aperture 535A. Transparent element 650B may correspond to aperture 535B and such that at least a portion of a front surface (not shown) of dispersing element 680B may be shown through aperture 535B.

Carrier 630 may be configured to carry light sources 540. For example, a Printed Circuit Board (PCB) may be installed in slit 640 and light sources 540 may be mounted on the PCB. Some of light sources 540 may be mounted on one side of the PCB and such that they may face dispersing element 680A. At least a portion of transparent element 650A including dispersing element 680A, may be configured to disperse the light emanating from these light sources and/or reduce the light intensity to prevent dazzling. Furthermore, at least a portion of transparent element 650A including dispersing element 680A may be configured to shield these light sources from environmental damages or any other damages which may be caused to these light sources through aperture 535A. Thus, transparent element 650A may be configured to serve as a barrier between these light sources and aperture 535A which may allow the transfer of light emanating from these light sources.

Some of light sources 540 may be similarly positioned to face dispersing element 680B of transparent element 650B, where at least a portion of transparent element 650B, including dispersing element 680B, may be configured to disperse and/or reduce the intensity of the light emanating from these light sources and shield them in a similar manner to transparent element 650A.

Light source assembly 600 is only an example for such an assembly and other configurations may be also utilized. Thus light source holder 610 may be in various shapes configured to hold the light sources. In some embodiments, the road marker device may have only one aperture or more than two. In such cases, a corresponding number of transparent elements may be utilized where one or more light sources may face each aperture. In some embodiments, more than one light source holder may be utilized. The transparent elements may have various shapes. In some embodiments, the transparent elements may have a shape corresponding to the shape of the apertures. In some embodiments only one transparent element may correspond to more than one aperture.

Thus, in particular, light source housing 530 may include one or more apertures such as apertures 535A and 535B to form a uni-directional or multi-directional road marker device 500. Accordingly, light source assembly 600 may include one or more transparent elements such as 650A and 650B corresponding to the one or more apertures. However, one transparent element may be positioned and/or structured such that it may face more than one aperture. Multiple light sources 540 may be mounted on source assembly 600 and such that one or more of light sources 540 may face a transparent element and each of the one or more apertures. In such configurations, one or more light source holders such as light source holder 610 may be utilized. For example, each light source holder may hold one or more light sources that may face a single aperture.

The tilt mechanism of road marker device 500 may be similar to tilt mechanism 200 of road marker device 100. Similarly to road marker device 100, the tilt mechanism may be coupled with light source housing 530. Optionally, the tilt mechanism may be coupled with light source housing 530 by a light housing footing such as light housing footing 260 of road marker device 100. The light housing footing may include screw holes such as screw holes 270 of light housing footing 260 and one or more utility openings, such as utility openings 280 of light housing footing 260. Light source housing 530 may be attached to the light housing footing by screws screwed through the screw holes. Light source assembly 600 may be mounted on the light housing footing and within light source housing 530. Light sources 540 may be mounted on light source assembly 600 and therefore within light source housing 530. The utility openings may be used, for example, to allow the passage of electric wires to light sources 540.

Alternatively, the resiliency mechanism of road marker device 500 may be similar to the resiliency mechanism of road marker device 100. The resiliency mechanism, similarly to the resiliency mechanism of road marker device 100, may include the seal and the light housing footing of the tilt mechanism of road marker device 500. Light source housing 530 may be coupled with the light housing footing as described herein above. Light source assembly may be mounted on the light housing footing as described herein above. The resiliency mechanism may operate similarly to the resiliency mechanism of road marker device 100.

Optionally, light source housing 530 may be coupled with the housing, e.g., top surface 510 (which may be lid 510), by the seal which may be similar to seal 300 of road marker device 100. Similarly to road marker device 100, the seal may be used to seal the coupling of light source housing 530 with the tilt mechanism or the light housing footing of the resiliency mechanism and flat top surface 510. The seal, similarly to seal 300, may include a top tapering portion such as top tapering portion 310, a bottom annular portion such as bottom annular portion 320 and a central cavity such as central cavity 340. The seal may be coupled with top surface 510 by screws inserted into the screw holes. Light source housing 530 may be received by the central cavity. Light source housing 530 may be coupled with the seal and/or the light housing footing in various manners, as known in the art. Optionally, an inner end portion of the top tapering portion (e.g., the lowest fold or portion of the elastic wall) may be pressed between an edge portion of the light housing footing and a bottom edge portion of light source housing 530. Thus, when light source housing 530 is firmly attached to the light housing footing (e.g., by screws inserted to the screw holes), the seal is firmly coupled with both therefore sealing the housing against environmental influences.

In some embodiments, the road marker device may further include an ice formation sensor and a dedicated colored LED. The ice formation sensor may be designated to alert of the risk of ice formation on the road. The ice formation sensor may be, for example, a temperature sensor, such as a thermometer. The dedicated colored LED may be, for example, a blue LED. The dedicated colored LED may be designated to alert users of the road of the risk of ice formation (e.g., when the temperature drops down and approaches zero degrees) by turning on.

In some embodiments, the road marker device may include one or more sensors which may provide environmental data, such as temperature, or traffic related data, such as traffic load (e.g., by utilizing a counter to count vehicles passing over the road marker device).

In some embodiments, the road marker device may further include a communication module. The communication module may be operatively coupled with a power source such as the solar panel. The communication module may transmit signals to a control center and/or to a service vehicle when it passes close by. Such signals may indicate technical failure or various technical alerts (e.g., a battery is low or the solar panel is not charging). Such communication module may use a wired communication, such as internet, and/or a wireless communication such as cellular and/or radio-based transmission.

In some embodiments, the communication module may be utilized to control the operation of the road marker device. In some embodiments, a network of multiple road marker devices, such as road marker device 100 and/or road marker device 500, spread over a network of roads, may be formed. Accordingly, such a network of road marker devices is further disclosed. The network may be wired and/or wireless. The control center may then remotely control the operation of the road marker devices in the network.

In some embodiments the control center may be embodied as dedicated software application (or simply 'the application'), to which authorized personnel, authorities or services (e.g., governmental authorities, municipal authorities or emergency services) may have access. The application may be executed by at least one hardware processor and may run on a stationary and/or mobile computing device (e.g., desktop computer, laptop computer, a server, a tablet or a smartphone). The application may communicate with a database, which may, for example, be stored on a server in a network such as the internet. The server may include data relating to the road marker devices in the network and to the roads network (e.g., number, technical features, location and the operation status of the road marker devices and/or the location and status of the roads in the roads network). In some embodiments, the application may be configured to automatically control the operation of the road marker devices unless interrupted.

Communication with the road marker devices network may be, for example, over a cellular network. In such embodiments, the communication module of at least a portion of the road marker devices may include a Global System for Mobile Communication (GSM) modem to facilitate communication with the control center. Alternatively or additionally, the communication with the control center may be facilitated via GSM modems deployed separately over the roads network (i.e., not as part of the road marker device).

The communication with the road marker devices may be unidirectional or bi-directional for controlling the operation of the road marker devices and/or receive alerts and messages from the road marker devices. The alerts and/or messages may relate, for example, to technical issues or environmental related or traffic related data. Controlling of the operation of a road marker device (e.g., via the dedicated application) may include turning one or more light sources of the road marker device on or off. For example, turning on or off one or more light sources illuminating in a specific direction (i.e., in road marker devices having more than one aperture) or in specific colors. Various colors of the light source may deliver various alerts or messages to the road users. Such alerts may increase the roads safety (e.g., when alerting of stationary traffic following an accident) and functionality (e.g., when informing of technical failures).

The network may further facilitate a dynamic delineation of roads and/or lanes, including changing the position, size (i.e., length and/or width), use, priority or direction of travel of lanes and/or roads or change the number of lanes in a road (e.g., adding an extra lane at traffic peak hours). These may be performed by turning on or off specific road markers and/or specific light sources of such road marker devices and of specific colors. The turning on or off may be in various manners, including intermittently and in various frequencies.

In some embodiments, the road marker device may be constructed of recyclable materials, such as aluminum and rubber, and an unusable device may be regenerated in suitable various industrial uses.

All of the elements described herein above in general or with respect to an embodiment of the road marker device, and with respect to road marker device 100 and/or road marker device 500, in particular, may be combined with any of the disclosed embodiments including road marker device 100 and/or road marker device 500.

A method for installing and/or maintaining and/or removing a road marker device is further disclosed.

In a first step, a road marker device may be provided. The road marker device may be similar to any of the disclosed embodiments, such as road marker device 100 or road marker device 500 and to a combination thereof. In general, the road marker device may include a housing having a flat top surface and at least one light source configured to resiliently retract into the housing upon application of external pressure.

In another step, a hole may be formed in a road. The hole may have at least the size of the road marker device. The hole may be in various shapes, such as circular or rectangular. The hole may be formed in a paved road, which may then require drilling the hole in the road. Alternatively, the hole may be formed when the road itself is formed. In such a case, the hole may be formed by sinking the road marker device in the wet concrete of the road. The road marker device may be then sunk in the road such that the flat top surface of the road marker device will be leveled with the surface of the road.

In another step, the road marker device may be positioned inside the hole. The road marker device may be positioned such that the flat top surface of the road marker device is leveled with a surface of the road. Only the light source may protrude upwards from the road marker device.

Optionally, the positioning of the road marker device inside the hole may include positioning the road marker device such that the at least one aperture faces at least one direction from which users of the road arrive. If the road marker device includes more than one aperture configured to face multiple such directions, then the road marker device may be positioned in the hole such that each aperture may face its designated direction. If the road marker device includes an aperture configured to face more than one direction, it may be positioned such that it may face all of its designated directions. For example, in a bi-directional road, a road marker device may be installed along the separation line between the two opposing traffic directions to be used by users arriving from all of the directions of the road.

In an optional step, concrete may be poured into the hole. The positioning of the road marker device inside the hole may include sinking of the road marker device in the concrete while the concrete is still wet. The concrete may then solidify around the road marker device and firmly place the road marker device in the hole.

In an optional step, a lid of the road marker device may be removed. The removing of the lid may be performed via one or more slits of the lid. The lid may be removed for maintenance purposes or in order to remove the road marker device from the road. A dedicated device may be used to hold the lid by its slits and pull it up and away from the hole. Since the light source housing and the tilt mechanism may be attached to the lid, removal of the lid may allow simple and easy access to these components in case maintenance operations are required.

A road including at least one marker device according to the disclosed embodiments or according to a combination of these embodiment is further disclosed.

EXPERIMENTAL RESULTS

Multiple experiments have been conducted in order to establish the efficacy of present embodiments, and show their supremacy over other configurations.

The road marker device used in the following experiments is similar to road marker device 100 and includes a tilt mechanism similar to tilt mechanism 200 as described herein above.

Initially, a hole was drilled in an asphalt road larger than the diameter of the road marker device. Concrete was spilled into the hole and the road marker device was inserted into the concrete such that the top flat surface is leveled with the road surface.

In a first experiment, the durability and the capability of the road marker device to withstand pressure was tested.

A first vehicle (a family car: Kia Rio, 2008) having a weight of about one ton was driven back and forth over the road marker device multiple times with a maximal speed of 50 kilometers per hour. In addition, the first vehicle was suddenly stopped and accelerated over the road marker device. The flat top surface, the light source housing and the tilt mechanism were specifically examined and were found undamaged.

A second vehicle (a truck: Isuzu Sumo, 2007) having a weight of about eight tons was also driven back and forth over the road marker device multiple times with a maximal speed of 50 kilometers per hour. In addition, the second vehicle was suddenly stopped and accelerated over the road marker device. The flat top surface, the light source housing and the tilt mechanism were specifically examined and were found undamaged.

In a second experiment, the functionality of the seal of the road marker device was tested.

In a first phase, sand and various sizes of grit were scattered over the road marker device. The Kia Rio was used to drive over the road marker device multiple times in various speeds and up to 50 kilometers per hour. The functionality of the light source housing was examined and was found to be fine. The light source housing was not damaged and returned to its original position (i.e., protruding from the flat top surface). Furthermore, sand and grit was not found inside the light source housing.

In a second phase, the light source housing, while having sand and grit on it, was manually pushed down and beyond its maximum down level point (i.e., beyond 6 millimeter below its original protruding position and by pressing the shock absorber). As a result, no significant penetration of sand and grit into the light source housing was identified.

In a third phase, water was spilled on the sand and grit scattered on the light source housing. The Kia Rio was used to drive over the road marker device multiple times in various speeds and up to 50 kilometers per hour. The road marker device was not damaged and water did not penetrate to the light source housing.

Following the above, the road marker device was disassembled and only a relatively small portion of dirt and sand was found inside the device (i.e., inside the housing and the light source housing) which may not interfere with the operation of the device and the light source in particular.

In a fourth phase, a large amount of quartz sand was scattered over the flat top surface of the road marker device. The first vehicle (Kia Rio, 2008) was driven back and forth over the road marker device multiple times with a maximal speed of 40 kilometers per hour. As a result of that, the seal stayed intact and the accumulation of quartz sand around the seal (i.e., externally to the seal) was considerably smaller with respect to the previous stages.

In a further experiment, a road marker device according to the disclosed embodiments was submerged inside a one cubic meter water tank in depth of one meter, for more than 25 hours. The road marker device was then taken out from the water tank and was dried. The road marker device was opened and checked for water penetration. The road marker device was found completely dry and with no sign of moister. These results indicate that the road marker device complies with IP code 6x of the International Electrotechnical Commission (IEC) standard 60529.

The present invention may be a system, a device, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A road marker device comprising:

a road marker housing having a top surface, comprising an opening, said housing being configured for positioning within a hole in a road;

a light-source housing comprising at least one aperture and at least one light source disposed internally thereof, said light-source housing being configured to be moveably received through said opening such that a portion of said light-source housing comprising said at least one aperture is normally protruding above said top surface and can be lowered into the road marker housing upon the application of a downward pressure, a resilient seal having a central cavity, a bottom annular portion and a top hollow tapering portion, and wherein:

(i) said central cavity being configured to receive said light-source housing;

(ii) said bottom annular portion being configured to seal a coupling between the top surface of the road marker housing and the descending light source housing; and (iii) the top hollow tapering portion comprising elastic folds configured to pull said light-source housing upwards to said normally protruding position, when said downward pressure is removed.

2. The road marker device according to claim 1, wherein the elastic folds are configured to stretch downward when said pressure is applied.

3. The road marker device of claim 1, wherein the at least one light source comprises at least one Light Emitting Diode (LED).

4. The road marker device of claim 1, wherein the top surface comprises a pattern simulating the rough face friction coefficient of the road.

5. The road marker device of claim 1, wherein the light source housing further comprises a recess.

6. The road marker device of claim 1, wherein the light source housing further comprises an upper portion protruding from said top surface, and wherein said upper portion has a round shape.

7. The road marker device of claim 1, further comprising a power source configured to provide energy to said road marker device.

8. The road marker device of claim 7, wherein the power source comprises a solar panel.

9. The road marker device of claim 1, wherein said road marker housing comprises a container and said top surface is fixedly attached to said container and wherein said light source housing and said resilient seal are attached to said top surface lid.

10. The road marker device of claim 1, further comprising an ice formation sensor configured to alert of the risk of ice formation on the road.

11. The road marker device of claim 1, further comprising a light source assembly, wherein said light source assembly comprises a light source holder and one or more transparent elements, and wherein said at least one light source is mounted on said light source assembly to face at least one of said one or more transparent elements.

12. The road marker device of claim 1, wherein said road marker housing comprises a container and said top surface is firmly attached to said container.

13. The road marker device of claim 1, wherein said top surface comprises a lid configured to close the housing, and wherein said lid comprises one or more slits configured to facilitate the removal of said lid.

14. The road marker device of claim 1, wherein said top surface comprises a stationary flat lid.

15. The road marker device of claim 14, wherein said stationary flat lid comprises the opening and said light source is configured to resiliently move upwards from and downwards into said stationary flat lid through said opening.

16. The road marker device of claim 1, wherein said stationary flat lid comprises at least one opening and said resilient seal is coupled to said light source housing and a rim of said flat lid opening.

17. The road marker device of claim 1, wherein a longest dimension of said opening is less than 50% of a longest dimension of said stationary flat lid.

18. The road marker device of claim 1, wherein said road marker housing is configured for positioning within the hole in the road such that the top surface is leveled with a road surface.

19. The road marker device of claim 1, wherein the elastic folds are shaped to define a "V"-shaped cross section.

* * * * *